US005508152A

United States Patent [19]

Toyoda et al.

[11] Patent Number: 5,508,152

[45] Date of Patent: Apr. 16, 1996

[54] METHOD FOR PROCESSING A SILVER HALIDE PHOTOGRAPHIC MATERIAL

[75] Inventors: Harumi Toyoda, deceased, late of Kanagawa, by Takashi Toyoda, legal representative; Eiichi Okutsu, Kanagawa; Tadashi Ito, Kanagawa; Kiyoshi Morimoto, Kanagawa, all of Japan

[73] Assignee: Fuji Photo Film Co., Ltd., Kanagawa, Japan

[21] Appl. No.: 395,197

[22] Filed: Feb. 27, 1995

Related U.S. Application Data

[63] Continuation of Ser. No. 160,161, Dec. 2, 1993, abandoned.

[30] Foreign Application Priority Data

Dec. 7, 1992 [JP] Japan ..... 4-326975

[51] Int. Cl.[6] ..... G03C 5/31

[52] U.S. Cl. ..... 430/436; 430/438; 430/441; 430/478; 430/481; 430/483; 430/600; 430/607; 430/611; 430/613

[58] Field of Search ..... 430/435, 436, 430/438, 441, 478, 481, 483, 486, 489, 566, 600, 603, 607, 611, 613

[56] References Cited

U.S. PATENT DOCUMENTS

H1,294 3/1994 Yamada et al. ..... 430/567

4,610,954 9/1986 Torigoe et al. ..... 430/611

4,634,660 1/1987 Mifune et al. ..... 430/600

FOREIGN PATENT DOCUMENTS 60-115933 6/1985 Japan ..... G03C 5/26

*Primary Examiner*—Hoa Van Le

*Attorney, Agent, or Firm*—Sughrue, Mion, Zinn, Macpeak & Seas

[57] ABSTRACT

A processing method is disclosed, comprising development-processing a photographic material comprising a support having thereon a silver halide emulsion layer or a constituent layer adjacent to the emulsion layer which contains (i) a silver halide composition comprising at least one of silver bromochloride, silver chloroiodide, or silver bromochloroiodide each having a silver chloride content of 90 mole % or more, or silver chloride, and (ii) a compound represented by the following Formula (I)

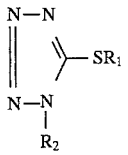

(I)

wherein $R_1$ represents a hydrogen atom, an ammonium group or an alkali metal atom; and $R_2$ represents a hydrogen atom, an alkyl group or an aryl group, with a developing solution containing (1) a dihydroxybenzene compound, and (2) an ascorbic acid or a derivative thereof in an amount of at least 5 mole % based on the amount of the dihydroxybenzene compound.

17 Claims, No Drawings

METHOD FOR PROCESSING A SILVER HALIDE PHOTOGRAPHIC MATERIAL

This is a Continuation of application Ser. No. 08/160,161 filed Dec. 2, 1993, now abandoned.

FIELD OF THE INVENTION

The present invention relates to a method for processing a silver halide photographic material with an automatic developing machine, specifically to a processing method in which the replenishing amount of developing solution per unit area of the photographic material can be reduced and a stable photographic performance can be obtained.

BACKGROUND OF THE INVENTION

In general, a black and white silver halide photographic material is processed by the steps of developing, fixing, rinsing and drying after exposing. Recently, photographic materials are processed most commonly with an automatic developing machine. In that case, the photographic material is suitably processed in a developing solution which is stored in a developing tank of the automatic developing machine while in contact with air. It has been desired to obtain the developing solution having excellent stability when such development-processing is carried out. Further, it has been desired to reduce further the needed replenishing solution amount per a unit area. Generally, at least 330 ml of each of the developing replenisher and the fixing replenisher have been conventionally used per $m^2$ of processed sheet-form photographic material such as an X-ray photographic material of a graphic arts photographic material.

However, since the waste liquors of the developing solutions and the fixing solutions have a high chemical oxygen demand (COD) or a high biochemical oxygen demand (BOD), the developing waste liquor and the fixing waste liquor are chemically or biochemically treated to render them harmless, and the waste liquors are then discarded. The disposal of such waste liquors is expensive. Accordingly, there is a need for a processing method which enables the replenishment rates of the developing solution and the fixing solution to be reduced even further.

Meanwhile, the use of a silver halide emulsion having a high silver chloride content (at least 90 mole % or more) is very advantageous for reducing the replenishing amount of the developing solution, because in case of silver bromide, bromine ions are released in the developing solution after developing and accumulate therein. The decrease in the amount of the replenishing solution leads to an increase in the accumulated bromine ions, increasing a development-inhibiting action, which exerts an adverse influence on photographic performance to a large extent. Meanwhile, in case of silver chloride, chlorine ions accumulate as well, but the development-inhibiting action is far smaller than with bromine ions, and no actual influence is involved. However, silver chloride is susceptible to a dissolving-physical developing action. That causes the problem of increased fog density, and room for improvement still remains.

SUMMARY OF THE INVENTION

An object of the present invention is to provide a (silver halide) photographic material for which the replenishing amount of the developing solution per unit area during the development-processing of the photographic material with an automatic developing machine is reduced, and a development-processing method therefor. Another object of the present invention is to provide a photographic material with which an excellent stability in photographic performance (and/or an excellent stability of the developing solution) can be obtained even with a development-processing using a reduced replenishing amount of developing solution, and a development-processing method therefor.

These and other objects of the present invention have been achieved by a a photographic material comprising a support having thereon a silver halide emulsion layer containing (i) a silver halide composition comprising at least one of silver bromochloride, silver chloroiodide, or silver bromochloroiodide each having a silver chloride content of 90 mole % or more, or silver chloride, and (ii) a compound represented by the following Formula [I]:

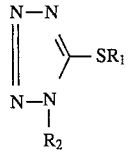

(I)

wherein $R_1$ represents a hydrogen atom, an ammonium group or an alkali metal atom; and $R_2$ represents a hydrogen atom, an alkyl group or an aryl group. The photographic material is subjected to a development-processing in a developing solution containing:

(1) a dihydroxybenzene compound, and (2) an ascorbic acid or a derivative thereof in an amount of at least 5 mole % based on the amount of dihydroxybenzenes.

Silver halide grains having a high silver chloride content constituting the photographic emulsions of the photographic material in the present invention include silver bromochloride, silver chloroiodide or silver bromochloroiodide grains having a silver chloride content of at least 90 mole % (as a mean value), or silver chloride grains. The silver iodide content is preferably not higher than 1 mole % (particularly 0.3 mole % or less). Particularly preferred is silver chlorobromide having a silver chloride content of at least 96 mole % (as a mean value) or silver chloride.

The high silver chloride emulsion used in the present invention has a silver bromide-localized phase in the silver halide grains thereof, in which a silver bromide content is relatively high as compared with that in the substrate thereof.

The preferred examples of such the localization structure is a structure having the localization phase on the surface of a silver halide grain or in the inside thereof close to the surface. In particular, preferred are the grains having the localization phase at the edge portion and corner portion on the crystal surface of the grains, or on a crystal face in the form of protrusion.

The silver bromide content of the halogen composition in the localization phase is generally from 10 to 95 mole %, preferably from 15 to 90 mole %, more preferably from 20 to 60 mole %, and most preferably from 30 to 60 mole %.

The remained silver halide of the localization phase preferably comprises silver chloride, but the very small amount of silver iodide may be contained as the remained silver iodide in the localization phase, and the amount of silver iodide does not preferably exceed 1 mole %.

Furthermore, the localization phase (i.e., a localized silver bromide phase) preferably occupies from 0.03 mole % to 10 mole %, particularly from 0.1 mole % to 10 mole %, of the entire amount of silver halide constituting the silver halide grains contained in the emulsion.

The localized silver bromide phase need not be of a single halogen composition, and may comprise two or more localized phases each having a different silver bromide content. The halogen composition may continuously vary at the interface between the localized silver bromide phase and the other phases (i.e., the change in silver halide composition between different phases need not be an abrupt change).

The above-described localized silver bromide phase can be formed, for example, by reacting a previously formed emulsion comprising silver chloride or high silver chloride content grains with a water-soluble silver salt and a water-soluble halide containing a water-soluble bromide by a double jet method to deposit a localized silver bromide phase on the grains; by converting a part of the silver chloride or high silver chloride content grains previously formed into a silver bromide high phase using a halogen conversion method; or by adding fine silver bromide or high silver bromide content grains (having a finer grain size than that of the base silver chloride or high silver chloride content grains) and another sparingly soluble silver salt to silver chloride or high silver chloride content grains to recrystallize silver bromide on the surfaces of the silver chloride or high silver chloride content base grains, to thereby form a localized silver bromide phase.

A useful method for forming a localized silver bromide phase on high silver chloride content grains is described in European Patent (Laid-Open) No. 0,273,430A2.

The silver bromide content of the silver bromide localized phase can be analyzed by X-ray diffractometry (e.g., as described in *Shinjikken Kaqaku Koza 6, Kozo Kaiseki*, edited by Nippon Kagaku Kai, published by Maruzen, Japan) or an XPS method (e.g., as described in *Surface Analysis,—IMA, Application of O. J. Electron, Photoelectron Spectroscopy*, published by Kodansha, Japan). Furthermore, the localized silver bromide phase can be observed through an electron microscope, or can be analyzed by the method described in European Patent (Laid-Open) No. 0,273,430A2.

Of these methods, the method wherein silver bromide and/or silver chlorobromide are formed on the surfaces of high silver chloride content grains in the emulsion during chemical ripening is particularly useful for forming a high silver bromide content layer (i.e., a localized silver bromide phase) in the present invention. This method is preferred for obtaining high sensitivity and reducing fog.

The effects of the present invention under various processing conditions are enhanced by incorporating into the silver halide grains metal ions other than silver ion (e.g., one or more metal ions selected from metals of Group VIII, transition metals of Group II, lead of Group IV, metals of Group I, in the Periodic Table and copper) or complex ions thereof. These metal ions or complex ions may be uniformly incorporated into the silver halide grains, or into the above-described localized silver bromide phase alone, or into other phases.

Of these metal ions or complex ions thereof, metal ions selected from the group consisting of iridium ion, palladium ion, rhodium ion, zinc ion, iron ion, platinum ion, gold ion and copper ion are particularly useful. When these metal ions or complex ions are used in combination, rather than alone, desirable photographic characteristics can often be obtained. Preferably, different metal ion species and addition amounts thereof are used in the localized silver bromide phase as opposed to the other portions of the silver halide grains. Iridium ion or rhodium ion are particularly preferably incorporated into the localized silver bromide phase.

The metal ions or the complex ions thereof can be introduced into the localized silver bromide phase of the silver halide grains and/or other portions of the grains by directly adding them to a reaction vessel during physical ripening before, during or after the formation of the silver halide grains; or by adding the metal ions or complex ions thereof to an aqueous solution of a water-soluble halide or a water-soluble silver salt which is then reacted to form the silver halide grains. When the localized silver bromide phases are formed by using fine silver bromide or high silver bromide content grains, the metal ions or the complex ions can be incorporated into the silver bromide fine grains or high silver bromide content fine grains in the same manner as described above. Then, the obtained fine grains containing the metal ions or complex ions thereof are added to a silver chloride or high silver chloride content emulsion. The metal ions or the complex ions may be introduced into the localized silver bromide phases by adding sparingly soluble bromides of the above metal ions in the form of a solid or powder while forming the localized phases.

The size of the silver halide grains used in the present invention is not larger than 0.4 μm, preferably 0.35 μm or less, and more preferably 0.3 μm or less.

Grains having a smaller size are preferred for obtaining a high covering power, and the silver/binder ratio can also be reduced.

The grain size distribution of the silver halide grains may be wide or narrow. However, monodispersed emulsions are preferred for providing enhanced photographic characteristics such as latent image stability, pressure resistance, etc., and for promoting improved processing stability, such as less variation in photographic characteristics with a change in developing solution pH, etc. The value S/d obtained by dividing the standard deviation S in grain size distribution by the mean grain size (the diameter of the silver halide grain is defined as the diameter of a circle having an area equal to the projected area of the grain, and the mean value of the diameters is referred to as the mean grain size) is preferably 20% or less, more preferably 15% or less.

Silver chloride emulsions, silver chlorobromide emulsions or silver chloroiodobromide emulsions for use in the present invention can be prepared by using the methods described, e.g., in P. Glafkides, *Chimie et Physique Photographique* (Paul Montel 1967), G. F. Duffin, *Photographic Emulsion Chemistry* (Focal Press 1966), and V. L. Zelikman et al., *Making and Coating Photographic Emulsion* (Focal Press 1964). Namely, any of the acid processes, neutral processes and ammonia processes can be used in the present invention. However, the acid processes and the neutral processes are particularly preferred for reducing fog. A soluble silver salt and a soluble halide can be reacted by any of the single jet process, the double jet process or a combination thereof to obtain the silver halide emulsions. A reverse mixing method wherein grains are formed in the presence of excess silver ion can be used. The double jet process is preferred for obtaining monodispersed grain emulsions preferably used in the present invention. A controlled double jet process wherein the concentration of silver ion in the liquid phase, in which silver halide is formed, is maintained constant is more preferred. Using this method, a silver halide emulsion having a regular crystal form and a narrow grain size distribution can be obtained, which is preferred in the present invention.

A cadmium salt, a zinc salt, a lead salt, a thallium salt, an iridium salt or a complex salt thereof, a rhodium salt or a complex salt thereof, or an iron salt or a complex salt thereof may be present during formation of the above Silver halide grains or during the physical ripening thereof.

Silver halide solvents (e.g., conventional solvents, such as ammonia, thiocyanates, or thioethers or thione compounds described in U.S. Pat. No. 3,271,157, JP-A-51-12360 (the term "JP-A" as used herein means an "unexamined published Japanese patent application"), JP-A-53-82408, JP-A-53-144319, JP-A-54-100717 or JP-A-54-155828) may be used during or after formation of the grains. When these solvents are used in combination with the above-described methods, silver halide emulsions having a regular crystal form and a narrow grain size can be obtained which is preferred in the present invention.

Soluble salts can be removed from the emulsions after physical ripening by noodle washing, a flocculation precipitation method or ultrafiltration.

The emulsions for use in the present invention can be chemical-sensitized by sulfur sensitization, selenium sensitization, reduction sensitization or noble metal sensitization alone or in combination thereof. Namely, sulfur sensitization methods using compounds containing a sulfur compound capable of reacting with active gelatin or silver ion (e.g., thiosulfates, thiourea compounds, mercapto compounds, rhodanine compounds), reduction sensitization methods using reducible materials (e.g., stannous salts, amines, hydrazine derivatives, formamidinesulfinic acid, silane compounds), and noble metal sensitization methods using metallic compounds (e.g., gold complex salts or salts of Group VIII metals such as platinum iridium, palladium rhodium and iron or complex salts thereof) can be used alone or in combination. Sulfur sensitization or selenium sensitization is preferred for the emulsions for use in the present invention. Sulfur sensitization or selenium sensitization is preferably used in combination with gold sensitization. Furthermore, in order to control sensitivity and gradation, chemical sensitization is preferably carried out in the presence of a hydroxyazaindene compound or a nucleic acid.

Preferred spectral sensitizing dyes for use in the present invention include those having a wavelength sensitivity in the range of at least 600 nm as described in JP-A-3-11336, JP-A-64-40939, JP-A-4-324855, JP-A-5-45833, Japanese Patent Application Nos. 2-266934, 3-36632, 3-266959 and 3-311498.

These sensitizing dyes may be used either alone or in combination. A combination of sensitizing dyes is often used for the purpose of supersensitization. In addition to the sensitizing dyes, the emulsions may contain a dye which itself does not have a spectral sensitizing effect, or a substance which does not substantially absorb visible light, but has a supersensitizing effect.

Examples of useful sensitizing dyes, combinations of sensitizing dyes for supersensitization and substances having a supersensitizing effect are described in *Research Disclosure* 176, No. 17643 (December 1978), page 23, Item IV-J, JP-B-49-25500 (the term "JP-B" as used herein means an "examined Japanese patent publication"), JP-B-43-4933, JP-A-59-19032 and JP-A-59-192242.

The optimum amount of the spectral sensitizing dye having a wavelength sensitivity of at least 600 nm preferably used in the present invention depends on the grain sizes of the silver halide grains contained in the emulsions, the halogen compositions of the grains, the type and degree of chemical sensitization, the relationship between the layer to which the sensitizing dye is added and the silver halide emulsion, the type of antifogging agents, etc. The optimum addition amount of the spectral sensitizing dye can readily be determined experimentally by those skilled in the art. Generally, the spectral sensitizing agents are used in an amount of preferably $1\times10^{-7}$ to $1\times10^{-2}$ mole, particularly preferably $1\times10^{-6}$ to $5\times10^{-3}$ mole, per mole of silver halide.

The compound represented by Formula (I) is incorporated into the photographic material according to the present invention for the purpose of preventing fog or stabilizing the photographic performance during the production process, storing or photographic processing of the photographic material.

In the above mentioned formula, the alkali metal atom represented by $R_1$ includes, for example, a sodium atom and a potassium atom (particularly preferably a sodium atom and a potassium atom). The alkyl group represented by $R_2$ includes an alkyl group having 1 to 6 carbon atoms, for example, methyl, ethyl, propyl, and hexyl. Phenyl and naphthyl groups can be mentioned as the aryl group (preferably having 6 to 12 carbon atoms) represented by $R_2$. The above aryl group may further have a substituent (for example, a sulfonic acid group, a carbonic acid group, a hydroxyl group, a halogen atom and an alkylureido group).

The compound represented by Formula (I) is used in the photographic material of JP-A-60-115933, but the present invention relates to a processing method for development-processing the photographic material containing the compound represented by Formula (I) with a developing solution containing an ascorbic acid or a derivative thereof.

Concrete examples of the compound represented by Formula (I) are shown below but the present invention is not limited to these compounds.

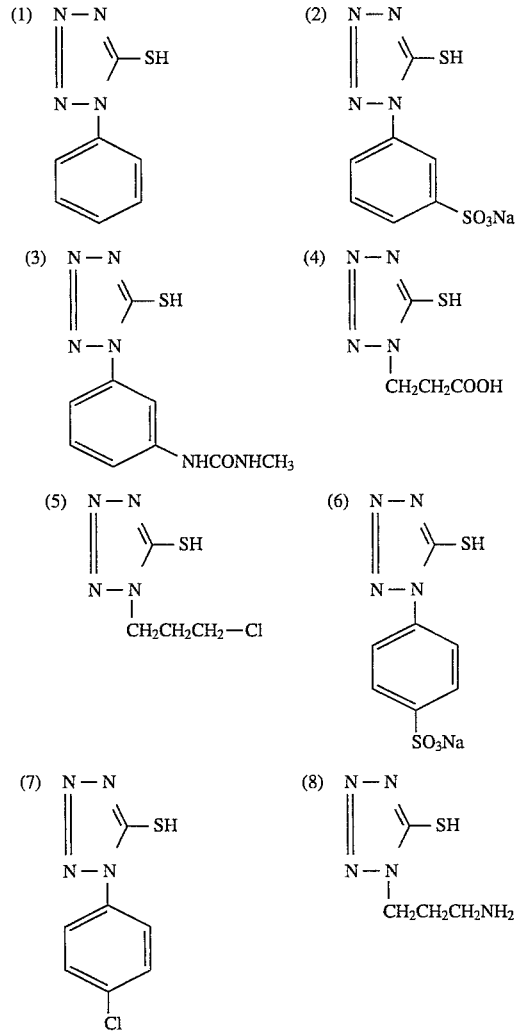

-continued (9)

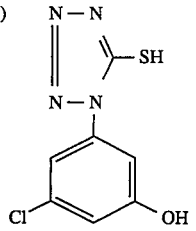

(10)

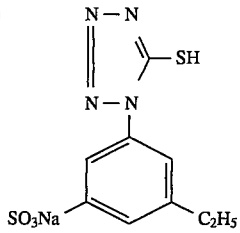

(11)

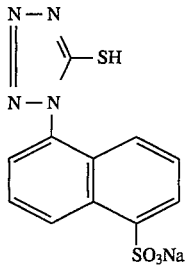

(12)

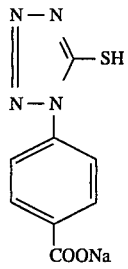

(13)

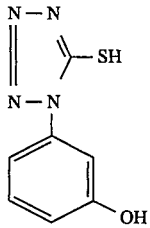

(14)

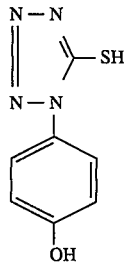

(15)

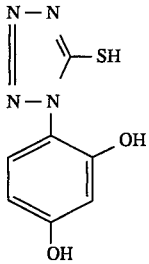

(16)

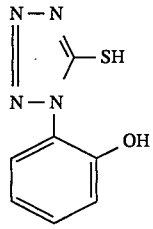

As is generally known well, the compounds represented by Formula (I) can be synthesized by the method in which isothiocyanate is used as a starting raw material.

The patents and literature references in which the instructive synthetic methods are described are shown below: U.S. Pat. Nos. 2,585,388 and 2,541,924, JP-B-42-21842, U.S. Pat. No. 3,266,897, JP-A-53-50169, U.S. Pat. No. 1,275,701, D. A. Berges et al, *Journal of Heterocyclic Chemistry*, Vol. 15, No. 981 (1978), *The Chemistry of Imidazole and Derivatives*, Part I, pp. 336 to 339, Chemical Abstract 58, No. 7921 (1963), p. 394, E. Hoggarth, *Journal of Chemical Society*, Vol. 1949, pp. 1160 to 1167, S. R. Sandler and W. Karo, *Organic Functional Group Preparation*, published by Academic Press in 1968, pp. 312 to 315, M. Chamdon et al, *Bull. Soc. Chim. Fr.*, 723 (1954), D. A. Shirley and D. W. Alley, *J. Amer. Chem. Soc.*, 79, 4922 (1957), and A. Wohl and W. Marck Wald, *Germany Chemical Society (Ber)*, Vol. 22, p. 568 (1889).

These compounds represented by Formula (I) can be added at an arbitrary period during preparation of the silver halide emulsion. They are effectively added after chemical ripening is finished when chemical ripening is carried out, and during the period after finishing physical ripening upto coating on a support when chemical ripening is not carried out. These compounds can be incorporated as well into a silver halide emulsion layer or a constituent layer adjacent to this emulsion layer in a photographic material. They are preferably added to the silver halide emulsion layer.

The addition amount of the compounds represented by Formula (I) according to the present invention is within the range of preferably 50 to 500 mg, more preferably 70 to 400 mg, per mole of silver halide.

Further, the compound releasing an inhibitor during a development, described in JP-62-30243, can be incorporated for the purpose of acting as a stabilizer.

The photographic material of the present invention may contain a developing agent such as a hydroquinone derivative and a phenidone derivative to serve as a stabilizer or an accelerator.

The photographic emulsion layers and other hydrophilic colloid layers of the photographic material of the present invention may contain an inorganic or organic hardening agent. Examples of the inorganic or organic hardening agents include chromium salts (e.g., chromium alum, chromium acetate), aldehydes (e.g., formaldehyde, glutaraldehyde), N-methylol compounds (e.g., dimethylol urea), dioxane derivatives, active vinyl compounds (e.g., 1,3,5-triacryloyl-hexahydro-s-triazine, 1,3-vinylsulfonyl-2-propanol), active halogen compounds (e.g., 2,4-dichloro-6-hydroxy-s-triazine) and mucohalogenic acids (e.g., mucochloric acid). These compounds may be used either alone or in combination of two or more thereof.

The hydrophilic colloid layers of the black-and-white photographic material which is a photographic material of the present invention may contain water-soluble dyes as filter dyes or anti-irradiation dyes. Examples of water-soluble dyes useful in the present invention include oxonol dyes, hemioxonol dyes, styryl dyes, merocyanine dyes, cyanine dyes and azo dyes. Particularly, oxonol dyes, hemioxonol dyes and merocyanine dyes are preferred.

The support for the photographic material of the present invention preferably has a thickness of 150 to 250 μm to promote handleability when observation is made on a medical light table. Polyethylene terephthalate film is preferred as a material for the support. Blue-colored material is particularly preferred.

The surfaces of the support are preferably subjected to corona discharge treatment, glow discharge treatment or ultraviolet light irradiation treatment to improve adhesion between the support and an adjoining hydrophilic colloid layer. Alternatively, a subbing layer comprising a styrene-butadiene latex or a vinylidene chloride latex may be provided on the surface of the support. Furthermore, a gelatin layer may be provided thereon.

A subbing layer-may be provided by using an organic solvent containing a polyethylene swelling agent and gelatin as a coating liquid.

When the subbing layer is subjected to surface treatment, the adhesion between the support and the hydrophilic colloid layer can be further improved.

The total gelatin coating weight on the silver halide emulsion layer side of the support in the present invention is preferably 3.5 g/m$^2$ or less, more preferably 3.3 g/m$^2$ or less, most preferably 1.5 to 3.0 g/m$^2$.

The entire coating weight of the silver halide emulsion per one side of the support in the present invention is preferably not more than 2.6 g/m$^2$, more preferably not more than 2.3 g/m$^2$, most preferably 1.0 g/m$^2$ to 2.0 g/m$^2$, in terms of silver.

The ratio by weight of silver to gelatin in the silver halide emulsion layer is an important factor from the standpoint of rapid processability. For processing in an automatic processor, when the ratio of silver to gelatin in the silver halide emulsion layer is increased, emulsion pick-off occurs in which the emulsion layer is peeled off by protrusions on the rollers so that an image is hardly observed. In view of the above, the ratio by weight of silver to gelatin in the silver halide emulsion layer is preferably 1.4 or less, more preferably 1.2 or less, most preferably 0.5 to 1.1.

Additives, methods and layer structures described in the following patent specifications can be used to prepare the photographic material of the present invention.

| Item | Places |
|---|---|
| (1) Chemical sensitization method | The 13th line of right upper column to the 16th line of left upper column of page 10 of JP-A-2-68539; and Japanese Patent Application No. 3-105035. |
| (2) Anti-fogging agent, stabilizer | The 17th line of left lower column of page 10 to the 7th line of left upper column of page 11 of JP-A-2-68539; and the second line of left lower column of page 3 to left lower column of page 4 of JP-A-2-68539. |
| (3) Color tone improver | The 7th line of left lower column of page 2 to the 20th line of left lower column of page 10 of JP-A-62-276539; and the 15th line of left lower column of page 6 to the 19th line of right upper column of page 11 of JP-A-3-94249. |
| (4) Surfactant, antistatic agent | The 14th line of left upper column of page 11 of the 9th line of left upper column of page 12 of JP-A-2-68538. |
| (5) Matting agent, lubricant (sliding agent), plasticizer | The 10th line of left upper column to the 10th line of right upper column of page 12 of JP-A-2-68539; and the 10th line of left lower column to the first line of right lower column of page 14 of JP-A-2-68539 |
| (6) Hydrophilic colloid | The 11th line of right upper column to the 16th line of left lower column of page 12 of JP-A-2-68539. |
| (7) Hardening agent | The 17th line of left lower column of page 12 to the 6th line of right upper column of page 13 of JP-A-2-68539. |
| (8) Polyhydroxybenzenes | Left upper column of page 11 to left lower column of page 12 of JP-A-3-39948; and EP 452,772A. |
| (9) Layer structure | JP-A-3-198041 |

The developing agent for use in the developing solution of the present invention is a dihydroxybenzene developing agent. Examples of the dihydroxybenzene developing agent include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone and hydroquinonemonosulfonic acid. Of these compounds, hydroquinone is particularly preferred. The dihydroxybenzene developing agent is generally used in an amount of from 0.05 to 0.8 mole/l (particularly preferably from 0.1 to 0.5 mole/l.

In the present invention, the dihydroxybenzene developing agent is preferably used together with a 1 -phenyl-3-pyrazolidone compound or a p-aminophenol compound.

Examples of the 1-phenyl-3-pyrazolidone compound include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone and 1-phenyl-5-methyl-3-pyrazolidone.

Examples of the p-aminophenol compound include N-methyl-p-aminophenol, N-(β-hydroxyethyl)-p-aminophenol, N-(4-hydroxyphenyl)glycine, 2-methyl-p-aminophenol and p-benzylaminophenol. Particularly, N-methyl-p-aminophenol is preferred.

When the dihydroxybenzene developing agent is used in combination with an auxiliary developing agent such as a 1-phenyl-3-pyrazolidone compound or a p-aminophenol compound, the former is used in an amount of preferably 0.05 to 0.5 mole/l, and the latter is used in an amount of preferably 0.001 to 0.06 mole/l, particularly preferably 0.003 to 0.06 mole/l.

Examples of sulfites for use in the developing solution of the present invention include sodium sulfite, potassium sulfite, lithium sulfite, ammonium sulfite, sodium bisulfite, potassium metabisulfite and formaldehyde-sodium bisulfite adduct. The sulfite is used in an amount of preferably at least 0.10 mole/l, particularly preferably at least 0.15 mole/l. The upper limit is preferably 2.5 mole/l, particularly preferably 1.2 mole/l.

The compound represented by the following Formula (II) is preferred as the ascorbic acid or the derivative thereof:

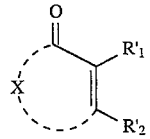

(II)

wherein $R'_1$ and $R'_2$ each represents a hydroxy group, an amino group, an acylamino group, an alkylsulfonylamino group, an arylsulfonylamino group, an alkoxycarbonylamino group, a mercapto group, and an alkylthio group; and X comprises a carbon atom, an oxygen atom or a nitrogen atom and forms a 5- to 6-membered ring together with the two vinyl carbons on which $R'_1$ and $R'_2$ are substituted and a carbonyl carbon.

Formula (II) is described below in detail.

In the formula, $R'_1$ and $R'_2$ each represent a hydroxy group, an amino group (including an alkyl group having a carbon number of 1 to 10 as a substituent, for example, methyl, ethyl, n-butyl, and hydroxyethyl), an acylamino group (for example, acetylamino and benzoylamino), an alkylsulfonylamino group (for example, methanesulfonylamino), an arylsulfonylamino group (for example, benzenesulfonylamino and p-toluenesulfonylamino), an alkoxycarbonylamino group (for example, methoxycarbonylamino), a mercapto group, and an alkylthio group (for example, methylthio and ethylthio). The preferred examples of $R'_1$ and $R'_2$ include a hydroxy group, an amino group, an alkylsulfonylamino group, and an arylsulfonylamino group. X is composed of a carbon atom, an oxygen atom or a nitrogen atom and forms a 5- to 6-membered ring together with the two vinyl carbons on which $R'_1$ and $R'_2$ are substituted and the carbonyl carbon. Concrete examples of X are composed of the combination of —O—, $—C(R_3)(R_4)—$, $—C(R_5)=$, —C(=O)—, $—N(R_6)—$, and —N=, wherein $R_3$, $R_4$, $R_5$ and $R_6$ each represents a hydrogen atom, an alkyl group which has a carbon number of 1 to 10 and may be substituted (a hydroxy group, a carboxy group and a sulfo group can be illustrated as a substituent), an aryl group which has a carbon number of 6 to 15 and may be substituted (as a substituent, an alkyl group, a halogen atom, a hydroxy group, a carboxy group, and a sulfo group can be illustrated as a substituent), a hydroxy group, and a carboxy group. Further, this 5- to 6-membered ring may form a saturated or unsaturated condensed ring. There can be listed as examples of this 5- to 6-membered ring, a dihydrofuranone ring, a dihydropyrone ring, a pyranone ring, a cyclopentenone ring, a cyclohexenone ring, a pyrrolinone ring, a pyrazolinone ring, a pyridone ring, an azacyclohexenone ring, a uracil ring. There can be mentioned as the preferred examples of the 5- to 6-membered ring, a dihydrofuranone ring, a cyclopentenone ring, a cyclohexenone ring, a pyrazolinone ring, an azacyclohexenone ring, and a uracil ring.

Concrete examples of the compound (i.e., the ascorbic acid and the derivative thereof) represented by Formula (II) are shown below.

(A-1)

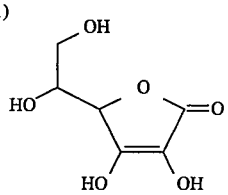

(A-2)

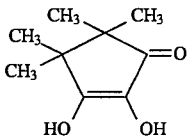

(A-3)

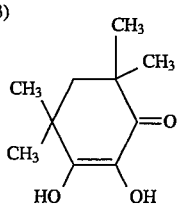

(A-4)

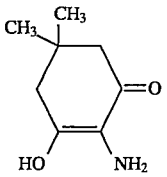

(A-5)

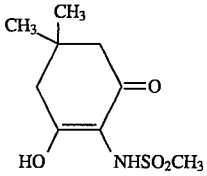

(A-6)

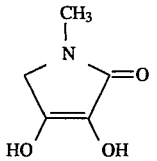

(A-7)

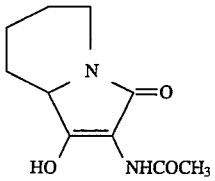

(A-8)

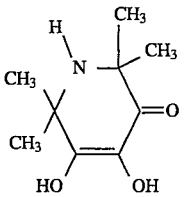

(A-9)

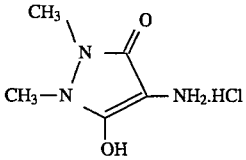

(A-10)

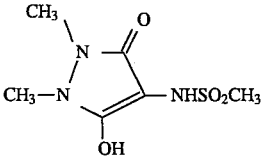

(A-11)

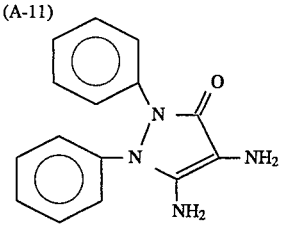

-continued (A-12)

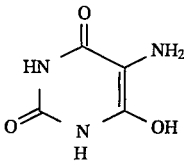

(A-13)

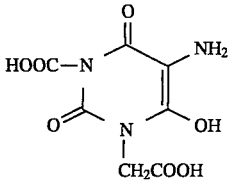

(A-14)

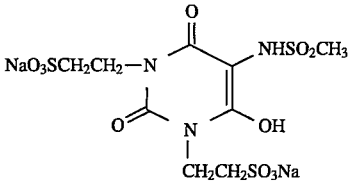

(A-15)

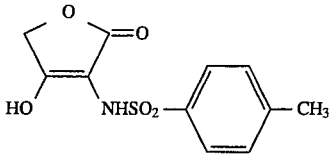

(A-16)

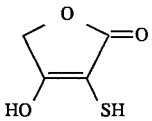

(A-17)

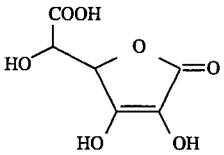

(A-18)

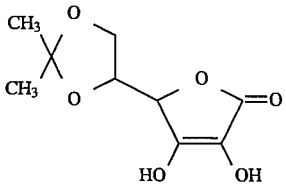

(A-19)

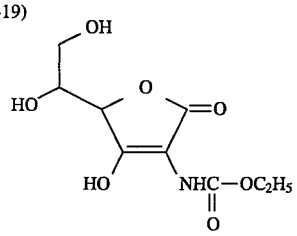

(A-20)

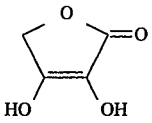

(A-21)

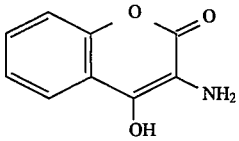

-continued (A-22)

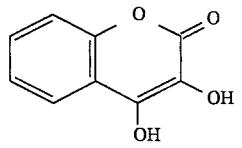

(A-23)

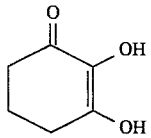

(A-24)

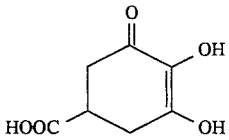

The developing solution for use in the present invention may contain an amino compound to accelerate development. The amino compounds described in JP-A-56-106244, JP-A-61-267759 and JP-A-2-208652 may be used.

A conventional water-soluble inorganic alkali metal salt (for example, sodium hydroxide and sodium carbonate) can be used for adjusting the pH value of the developing solution used in the present invention.

In addition to the above-described compounds, the developing solution for use in the present invention may contain a pH buffering agent such as boric acid, borax, sodium secondary phosphate, potassium secondary phosphate, sodium primary phosphate and potassium primary phosphate and the pH buffering agents described in JP-A-60-93433; a development inhibitor such as potassium bromide and potassium iodide; an organic solvent such as dimethylformamide, methyl cellosolve, hexylene glycol, ethanol and methanol; and a benzotriazole derivative such as 5-methylbenzotriazole, 5-bromobenzotriazole, 5-chlorobenzotriazole, 5-butylbenzotriazole and benzotriazole (particularly preferably 5-methylbenzotriazole), and a nitroindazole compound such as 5-nitroindazole, 6-nitroindazole, 4 -nitroindazole, 7-nitroindazole and 3-cyano-5-nitroindazole (particularly preferably 5-nitroindazole). When the developer contains a 5-nitroindazole, the developer is prepared by separately dissolving a portion containing a dihydroxybenzene developing agent and another portion containing a bisulfite preservative. When used, both portions are mixed together and water is added thereto. When the portion containing the dissolved 5-nitroindazole is alkalized, the portion is colored yellowed for convenience of handling.

Furthermore, the developing solution may contain a color toning agent, a surfactant, a hard water softener and a hardening agent. However, the developing solution does not substantially contain a boron compound.

Useful chelating agents for addition to the developing solution include ethylenediaminedi-o-hydroxyphenylacetic acid, diaminopropanetetraacetic acid, nitrilotriacetic acid, hydroxyethylethylenediaminetriacetic acid, dihydroxyethylglycine, ethylenediaminediacetic acid, ethylenediaminedipropionic acid, iminodiacetic acid, diethylenetriaminepentaacetic acid, hydroxyethyliminodiacetic acid, 1,3-diaminopropanoltetraacetic acid, triethylenetetraminehexaacetic acid, trans-cyclohexanediaminetetraacetic acid, ethylenediaminetetraacetic acid, glycol ether diaminetetraacetic acid, ethylenediaminetetrakismethylenephosphonic acid, diethylenetriaminepentamethylenephosphonic acid, nitrilotrimethylenephosphonic acid, 1-hydroxyethylidene-1,1-diphosphonic acid, 1,1-diphosphonoethane-2-carboxylicacid, 2-phosphonobutane-1,2,4-tricarboxylic acid, 1-hydroxy-1-phosphonopropane-1,3,3-tricarboxylic acid, catechol-3,5-disulfonic acid, sodium pyrophosphate, sodium tetrapolyphosphate and sodium hexametaphosphate. Of these compounds, diethylenetriaminepentaacetic acid, triethylenetetraminehexaacetic acid, 1,3 -diaminopropanoltetraacetic acid, glycol ether diaminetetraacetic acid, hydroxyethylethylenediaminetriacetic acid, 2-phosphonobutane-1,2,4-tricarboxylic acid, 1,1 -diphosphonoethane-2-carboxylic acid, nitrilotrimethylenephosphonic acid, ethylenediaminotetraphosphonic acid, diethylenetriaminepentaphosphonic acid, 1-hydroxypropylidene- 1,1-diphosphonic acid, 1-aminoethylidene-1,1-diphosphonic acid, 1-hydroxyethylidene-1,1-diphosphonic acid and salts thereof are particularly preferred.

In the present invention, the compounds described in JP-B-62-46585, JP-B-62-4702 and JP-B-62-4703, U.S. Pat. Nos. 4,254,215 and 3,318,701, and JP-A-58-203439, JP-A-62-56959, JP-A-62-178247, JP-A-1-200249, Japanese Patent Application Nos. 3-94955, 3-112275, and 3-233718 can be used for the developing solution as an anti-silver stain agent.

The methods described in JP-A-61-177132, JP-A-3-134666, and JP-A-3-67258 can be used as the method for preparing the processing solutions used in the present invention.

The method described in Japanese Patent Application No. 4-54131 can be used as the replenishing method for a developing solution in the processing method according to the present invention.

The fixing solution used in the present invention is an aqueous solution containing thiosulfate and has a pH of 3.8 or more, preferably 4.2 to 6.0.

The fixing agent includes sodium thiosulfate and ammonium thiosulfate. The use amount of the fixing agent can be suitably changed. The fixing solution may contain a water soluble aluminum salt which acts as a hardener. The examples thereof include aluminum chloride, aluminum sulfate and potassium alum.

Tartaric acid, citric acid, gluconic acid, and the derivatives thereof can be used for the fixing solution singly or in combination of two or more kinds. A fixing solution containing these compounds in the amount of 0.005 mole or more per liter of the fixing solution is effective. Particularly effective is a solution containing 0.01 to 0.03 mole/liter per liter of the fixing solution.

The fixing solution can contain a preservative (for example, sulfite and bisulfite), a pH buffer agent (for example, acetic acid and boric acid), a pH adjusting agent (for example, sulfuric acid), a chelating agent having a softening ability, and the compounds described in JP-A-62-78551 according to necessity.

The methods described in JP-A-1-4739 and JP-A-3-101728 can be used as the processing steps according to the present invention in order to accelerate fixing.

In the above processing method according to the present invention, a photographic material is processed in a rinsing water or a stabilizing solution after the developing and fixing processes and then is dried.

Various types of equipment such as a roller transport type and a belt transport type can be used as the automatic developing machine used in the present invention, and the automatic developing machine of the roller transport type is preferred. Further, the automatic developing machines having a developing tank with a small aperture rate (preferably 0.04 or less) as described in JP-A-1-166040 and JP-A-1-193853 can be used to enable an operation in which air oxidation and evaporation are decreased and which is stable to changes in the processing environment. A photographic material which finishes all processings in the automatic developing machine has a rinsing water squeezed off, that is, is dried after passing a squeeze roller. Drying is carried out at about 40° to about 100° C. The drying time is suitably changed according to the surrounding condition. It is usually about 5 seconds to 1 minute, particularly preferably about 5 to 30 seconds, at 40° to 80° C.

When processing is carried out over a period of generally 120 seconds or less (preferably 20 to 120 seconds) with Dry to Dry time in the photographic material processing system of the present invention, in order to prevent uneven development unique to rapid processing, rubber rollers as described in JP-A-63-151943 are preferably provided at the outlet of the development tank; the discharging flow rate is set to at least 10 m/min to stir the developing solution in the development tank as described in JP-A-63-151944; or the stirring intensity is increased during operation from a stand-by state as described in JP-A-63-264758. Furthermore, the rollers in the fixing solution tank are preferably opposed rollers to expedite the fixing rate in rapid processing. When opposed rollers are used, the number of rollers can be decreased and the capacity of the processing tank can be reduced. Namely, the automatic processors can be made more compacted.

When rinsing is carried out with a small amount of rinsing water in the method of the present invention, a squeeze roller washing tank as described in JP-A-63-18350 is preferably provided. Furthermore, a rinsing stage as described in JP-A-63-143548 is preferably used.

Furthermore, a part or all of the overflow solution from the rinsing bath (or washing bath) or the stabilizing bath can be reused for the processing solution having a fixing ability in a prestage as described in JP-A-60-235133, in which overflow solution is produced by replenishing the rinsing bath or the stabilizing bath with water treated with an antifungal means in the method of the present invention.

Multi-stage countercurrent systems (e.g., two-stage, three-stage) are well known as a means for reducing the replenishment rate of rinsing water. When a multi-stage countercurrent system (and a multi-room bath, if desired) is applied to the processing method of the present invention, rinsing is more efficiently accomplished. This is because the photographic material after fixing is processed in progressively cleaner rinse tanks. That is, the photographic material is brought into contact in the later processing stages with processing solutions which are not contaminated by the fixing solution.

An antifungal means for rinsing water or the stabilizing solution is preferably provided in the above-described water-saving system or non-piping system.

Examples of the antifungal means include an ultraviolet light irradiation method as described in JP-A-60-26393; a method using a magnetic field as described in JP-A-60-263940; a method wherein water is purified by using an ion exchange resin as described in JP-A-131632; and a method using antimicrobial agents as described in JP-A-61-115154, JP-A-62-t53952, JP-A-62-220951 and JP-A-62-209532.

Furthermore, antimicrobial agents, antifungal agents and the surfactants described in L. F. West, "Water Quality Criteria", *Photo. Sci. & Eng.*, Vol. 9, No. 6 (1965), M. W. Beach, "Microbiological Growths in Motion-picture Processing", *SMPTE Journal*, Vol. 8.5, (1976), R. D. Deegan, "Photo Processing Wash Water Biocides", *J. Imaging Tech*, 10 (6) (1984), JP-A-57-8542, JP-A-57-58143, JP-A-58-105145, JP-A-57-132146, JP-A-58-18631, JP-A-57-97530 and JP-A-57-157244 may be used in combination.

Further, there can be used the methods described in JP-A-2-269339, JP-A-3-168745, and JP-A-4-240636.

Furthermore, the isothiazoline compound described in R. T. Kreiman, *J. Image Tech*, 10 (6), page 242 (1984); the isothiazoline compounds described in *Research Disclosure*, Vol. 205, No. 20526 (May 1981); the isothiazoline compounds described in *Research Disclosure*, Vol. 228, No. 22845 (April 1983); and the compounds described in JP-A-62-209532 can be used as microbiocides in combination with the above-described compounds.

In addition thereto, the compounds described in *Antimicrobial Antifungal Chemistry*, written by Hiroshi Horiguchi published by Sankyo Shuppan (1982) and *Antimicrobial Antifungal Technical Handbook*, edited by Nippon Bokin Bobai Gakkai, published by Hakuhodo (1986) may be used.

The above anti-deposit agents (i.e., antimicrobial agents and antifungal agents) can be contained in a stock bath from which water is supplied to the wasing bath and the rinsing bath.

EXAMPLES

The examples are shown below but the present invention is not limited to these examples.

Example 1

1. Preparation of silver halide Emulsions A to E:

Gelatin (32 g) was added to distilled water (900 ml) to dissolve at 40° C. and then the pH was adjusted to 3.8 with sulfuric acid, followed by adding sodium chloride (3.3 g). A solution prepared by dissolving silver nitrate (32 g) in distilled water (200 ml) and a solution prepared by dissolving sodium chloride (11 g) and $K_2IrCl_6$ (0.02 mg) in distilled water (200 ml) were added and mixed into the above solution at 40° C. over a period of 2 minutes. Further, a solution prepared by dissolving silver nitrate (64 g) in distilled water (280 ml) and a solution prepared by dissolving sodium chloride (21.6 g) in distilled water (275 ml) were added and mixed at 40° C. over a period of 5 minutes. Subsequently, a solution prepared by dissolving silver nitrate (64 g) in distilled water (280 ml) and a solution prepared by dissolving sodium chloride (22.4 g) and $K_4Fe(CN)_6.3H_2O$ (0.04 g) in distilled water (285 ml) were added and mixed at 40° C. over a period of 5 minutes.

The emulsion thus-obtained was observed with an electron microscope to find that the emulsion comprises cubic grains having an average side length of about 0.21 μm and a variation coefficient of 9.8% in grain size distribution.

After this emulsion was desalted, gelatin (72 g) and phenoxyethanol (2.6 g) were added thereto. Then, the pH was adjusted to 6.7 and the pAg was controlled to 7.9 with NaCl. A chemical sensitization was carried out at 58° C. in the following procedure: first, a monodispersed silver bromide emulsion with an average grain size of 0.05 μm was added in the proportion corresponding to 1 mole % in terms of silver halide and then the exemplified compounds of Formula (I) (shown in Table 1) were added, followed by adding chlorauric acid (9.2 mg), triethylthiourea (1.3 mg), the selenium sensitizer (0.72 mg), and further nucleic acid (0.29 g). Finally, 4-hydroxy-6 -methyl-1,3,3a,7-tetraazaindene (162 mg) was added and the emulsion was rapidly cooled to solidify, whereby Emulsions A to E were prepared.

The contents of Emulsions A to E are shown in Table 1.

TABLE 1

| | Exemplified Compound of Formula (I) | Added Amount (mg/Ag mole) |
|---|---|---|
| Emulsion A | — | — |
| Emulsion B | (2) | 150 |
| Emulsion C | (3) | 180 |
| Emulsion D | (12) | 150 |
| Emulsion E | (13) | 140 |

Selenium Sensitizer

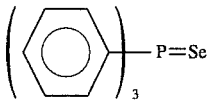

2. Preparation of the emulsion layer coating solutions

The following compounds per mole of silver halide were added to Emulsions A to E to prepare the emulsion layer coating Solutions A to E.

| Composition of the emulsion layer coating solution: | |
|---|---|
| Spectral Sensitizing Dye | $5.5 \times 10^{-5}$ mole |
| Supersensitizer | $3.3 \times 10^{-4}$ mole |
| Polyacrylamide (molecular weight: 40,000) | 9.2 g |
| Trimethylolpropane | 1.4 g |
| Poly(ethyl acrylate/methacrylic acid) latex | 22 g |

Spectral Sensitizing Dye

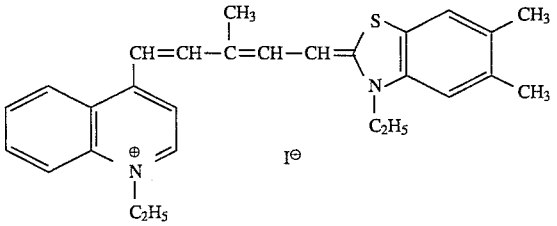

Supersensitizer

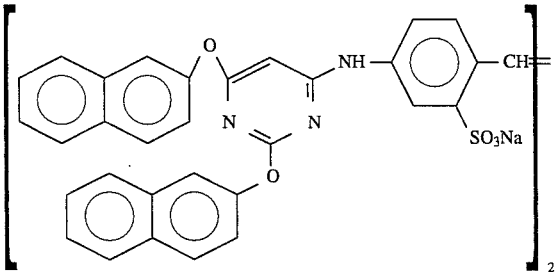

3. Preparation of the surface protective layer coating solution for the emulsion layer A vessel was heated to 40° C. and the following compounds were added to prepare the coating solution:

| | |
|---|---|
| Gelatin | 100 g |
| Polyacrylamide (molecular weight: 40,000) | 12.3 g |
| Poly(sodium styrenesulfonate) (molecular weight: 600,000) | 0.6 g |
| Polymethyl methacrylate fine grains (average grain size: 2.5 μm) | 2.7 g |
| Poly(sodium acrylate) | 3.7 g |
| Sodium t-octylphenoxyethoxyethanesulfonate | 1.5 g |
| $C_{16}H_{33}O—(CH_2CH_2O)—H$ | 3.3 g |
| $C_8F_{17}SO_3K$ | 84 mg |
| $C_8F_{17}SO_2N(C_3H_7)(CH_2CH_2O)_4(CH_2)_4—SO_3Na$ | 84 mg |
| NaOH | 0.2 g |
| Methanol | 78 ml |
| 1,2-Bis(vinylsulfonylacetoamide)ethane controlled so that the amount thereof became 2.5% by weight based on the whole amount of gelatin contained in the emulsion layer and surface protective layer. | |
| Compound (A) | 52 mg |

Compound (A)

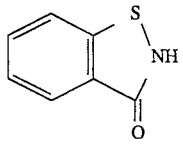

4. Preparation of the back layer coating solution

A vessel was heated to 40° C. and the following compounds were added to prepare the back layer coating solution:

| | |
|---|---|
| Gelatin | 100 g |
| Dye (A) | 2.38 g |

Dye (A)

-continued

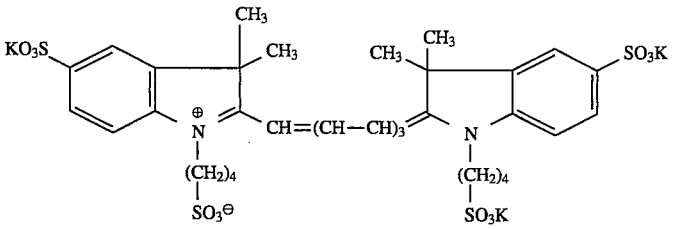

| | |
|---|---|
| Poly(sodium styrenesulfonate) | 1.1 g |
| Phosphoric acid | 0.55 g |
| Poly(ethyl acrylate/methacrylic acid) latex | 2.9 g |
| Compound (A) | 46 mg |
| Oil dispersion of Dye (B) described in JP-A-61-28544 | 246 mg as the dye itself |

Dye (B)

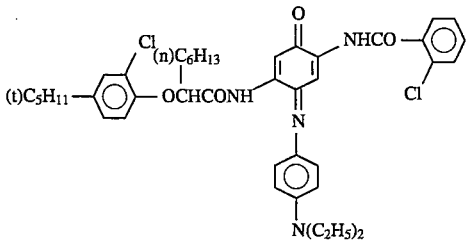

| | |
|---|---|
| Oligomer surface active agent dispersion of Dye (C) described in JP-A-62-275639 | 46 mg as the dye itself |

Dye (C)

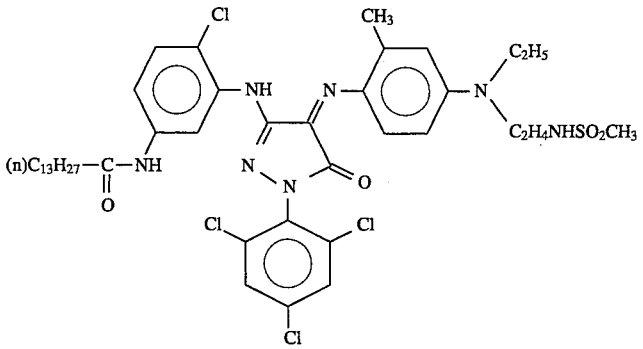

5. Preparation of the surface protective layer coating solution for the back layer A vessel was heated to 40° C. and the following compounds were added to prepare the coating solution:

| | |
|---|---|
| Gelatin | 100 g |
| Poly(sodium styrenesulfonate) | 0.3 g |
| Polymethyl methacrylate fine grains (average grain size: 3.5 μm) | 4.3 g |

-continued

| | |
|---|---|
| Sodium t-octylphenoxyethoxyethanesulfonate | 1.8 g |
| Poly(sodium acrylate) | 1.7 g |
| $C_{16}H_{33}O—(CH_2CH_2O)_{10}—H$ | 3.6 g |
| $C_8F_{17}SO_3K$ | 268 mg |
| $C_8F_{17}SO_2N(C_3H_7)(CH_2CH_2O)_4(CH_2)_4—SO_3Na$ | 45 mg |
| NaOH | 0.3 g |
| Methanol | 131 ml |
| 1,2-Bis(vinylsulfonylacetoamide)-ethane controlled so that the amount thereof became 2.2% by weight based on the whole amount of gelatin contained in the emulsion layer and surface protective layer. | |
| Compound (A) | 45 mg |

6. Preparation of the photographic material

The above mentioned back layer coating solution was coated on one side of a blue colored polyethylene terephthalate support together with the surface protective layer coating solution for the back layer so that the gelatin coating amounts of the back layer and the surface protective layer for the back layer were 2.69 g/m$^2$ and g/m$^2$, respectively.

Subsequently, the above mentioned emulsion layer coating Solutions A to E and the surface protective layer coating solution were coated on the another side of the support so that the coated Ag amount, the amount of gelatin coated on the emulsion layer and the amount of gelatin coated on the surface protective layer were 1.85 g/m$^2$, 1.6 g/m$^2$ and 1.23 g/m$^2$, respectively, whereby Photographic Materials A to E were prepared.

7. Preparation of a developing concentrate

| Developing Concentrate A | |
|---|---|
| Hydroquinone | 20 g |
| 1-Phenyl-4-methyl-4-hydroxymethyl-3-pyrazolidone | 2.5 g |

-continued

| Developing Concentrate A | |
|---|---|
| Potassium sulfite | 50 g |
| Sodium carbonate (monohydrate) | 25 g |
| Diethylene glycol | 10 g |
| Potassium bromide | 1 g |
| Diethylenetriaminepentaacetic acid | 2 g |
| 5-Methylbenzotriazole | 0.1 g |
| 2-Mercaptoimidazole-5-sulfonic acid | 0.3 g |
| 2,3,5,6,7,8-Hexahydro-2-thiooxo-4-(1H)-quinazolinone | 0.3 g |
| Water to make (adjusted to pH 10.5 with potassium hydroxide) | 400 ml |

Next, each of the exemplified compounds (A-1), (A-3), (A-9), (A-13), and (A-18) (0.04 mole) was added to the developing concentrate (400 ml ) and then the concentrate was adjusted once again to a pH 10.5 with potassium hydroxide, whereby Developing Concentrates B to F were prepared.

manner: that is, in the case where the developing solution was 1 liter, the developing concentrate 400 ml and water 600 ml were mixed; and in the case where the fixing solution was 1 liter, the fixing concentrate 500 ml and water 500 ml were mixed. This time, the automatic developing machine was modified so that when the samples entered into the automatic machine, the concentrate and water were automatically introduced and mixed in the developing tank and the fixing tank and the processing solution could be prepared. The photographic characteristics obtained are shown in Table 2. Sensitivity was defined by the logarithmic value of the reciprocal of the exposure amount providing the optical density of fog plus 1.0 obtained by processing the sample in a fresh solution of the developing solution and was expressed by the value relative to that of Sample 1, which was set at 100. Fog shows an optical density at an unexposed portion including that of a support. Dm shows a maximum density.

Stable photographic performance with a low fog could be obtained with the present invention even at the low replenishing amount of 150 ml/m$^2$.

TABLE 2

| | | | Photoaraphic Performance | | | | | |
|---|---|---|---|---|---|---|---|---|
| | Photographic | Developing | Fresh Solution | | | After Running for 3 Weeks | | |
| Sample No. | Material | Solution | Fog | Sensitivity | Dm | Fog | Sensitivity | Dm |
| 1 (Comp.) | A | A | 0.22 | 100 | 3.40 | 0.18 | 42 | 2.62 |
| 2 (Comp.) | A | B | 0.21 | 105 | 3.35 | 0.22 | 83 | 2.86 |
| 3 (Comp.) | A | C | 0.21 | 102 | 3.29 | 0.22 | 79 | 2.91 |
| 4 (Comp.) | A | D | 0.20 | 110 | 3. 31 | 0.21 | 76 | 2.89 |
| 5 (Comp.) | A | E | 0.21 | 108 | 3.32 | 0.22 | 72 | 2.90 |
| 6 (Comp.) | A | F | 0.22 | 105 | 3.28 | 0.21 | 80 | 2.87 |
| 7 (Comp.) | B | A | 0.14 | 102 | 3.31 | 0.13 | 39 | 2.55 |
| 8 (Inv.) | B | B | 0.14 | 102 | 3.35 | 0.14 | 103 | 3.38 |
| 9 (Inv.) | B | C | 0.14 | 105 | 3.41 | 0.14 | 101 | 3.36 |
| 10 (Inv.) | B | D | 0.14 | 103 | 3.39 | 0.14 | 102 | 3.38 |
| 11 (Inv.) | B | E | 0.14 | 102 | 3.40 | 0.14 | 101 | 3.39 |
| 12 (Inv.) | B | F | 0.14 | 102 | 3.39 | 0.14 | 103 | 3.40 |
| 13 (Comp.) | C | A | 0.14 | 101 | 3.41 | 0.13 | 42 | 2.61 |
| 14 (Inv.) | C | B | 0.14 | 103 | 3.38 | 0.14 | 101 | 3.39 |
| 15 (Inv.) | C | C | 0.14 | 100 | 3.42 | 0.14 | 99 | 3.41 |
| 16 (Comp.) | D | A | 0.14 | 102 | 3.43 | 0.13 | 43 | 2.59 |
| 17 (Inv.) | D | B | 0.14 | 104 | 3.38 | 0.14 | 102 | 3.35 |
| 18 (Inv.) | D | D | 0.14 | 102 | 3.36 | 0.14 | 101 | 3.38 |
| 19 (Comp.) | E | A | 0.14 | 100 | 3.39 | 0.13 | 39 | 2.49 |
| 20 (Inv.) | E | B | 0.14 | 101 | 3.41 | 0.14 | 102 | 3.41 |
| 21 (Inv.) | E | E | 0.14 | 99 | 3.32 | 0.14 | 98 | 3.35 |

8. Preparation of a fixing concentrate

| | |
|---|---|
| Sodium thiosulfate | 185 g |
| Disodium ethylenediaminetetraacetate dehydrate | 0.025 g |
| Sodium metabisulfite | 22 g |
| Water to make (adjusted to pH 6.0 with sodium hydroxide) | 500 ml |

With respect to the automatic developing machine, the driving axis of FCR-700 Laser Image Printer type CRLP414 (manufactured by Fuji Photo Film Co. , Ltd. ) was modified so that the transporting speed was set at 30 seconds from the insertion of a film to the outlet in a drier.

The photographic materials were subjected to a processing, each of 2 m$^2$ every day, and to a running test for 3 weeks while replenishing each 300 ml (150 ml/m$^2$) of Developing Solutions (a used solution) A to F and the fixing solution. The processing solutions were prepared in the following Example 2

There were used Photographic Materials B and E in Example 1 as the photographic material, Developing Concentrates B and C in Example 1 as the developing solution, and RF-10 (manufactured by Fuji Photo Film Co., Ltd.) as the fixing solution. The driving axis of FPM-1300 (manufactured by Fuji Photo Film Co., Ltd.) was modified so that the transporting speed was set at 70 seconds from the insertion of a film to the outlet of the drier.

The running test was carried out in the same conditions as those in Example 1 to confirm that stable photographic performance with a low fog could be obtained.

Preferred embodiments of the present invention:

1. In the processing method of the present invention, the developing solution has been stored in a vessel of a plastic packaging material having an oxygen permeation of 50 ml/m$^2$, atm.day or less at temperature of 20° C. and relative humidity of 65%.

2. In the processing method of the present invention, the support is transparent and the emulsion layer contains silver halide grains having a (100) face/(111) face ratio of 5 or more and having been spectrally sensitized to 600 nm or more and the material further comprises a colored back layer.

3. In the processing method of the present invention, the support is transparent and the emulsion layer contains silver halide grains having a (111) face/(100) face ratio of 5 or more and having been spectrally sensitized to 600 nm or more and the material further comprises a colored back layer.

4. In the processing method of the present invention, the photographic material has a coated silver amount of 2.6 $g/m^2$ or less and a total gelatin amount of 3.5 $g/m^2$ or less.

5. In the processing method of the present invention, a developing concentrate and a fixing concentrate consisting of one part and each of the concentrates is diluted to a processing solution with water in each tank and supplied as a replenishing solution.

6. In the processing method of the present invention, a vessel for the developing concentrate and the fixing concentrate is an integrated packaging material.

7. In the processing method of the present invention, the amounts of the developing concentrate and the fixing concentrate contained in the vessel are consumed at the same time.

8. In the processing method of the present invention, there is used an automatic developing machine in which a rinsing bath and a rinsing roller (a crossover roller) are disposed between a developing bath and a fixing bath and between the fixing bath and a washing bath.

9. In the processing method of the present invention, the processing occurs in an automatic developing machine in which various anti-deposit agents are contained in a stock bath from which water is supplied to the washing bath and the rinsing bath.

10. In the processing method of the present invention, the processing occurs in an automatic developing machine in which an electromagnetic valve is disposed at an exhaust port of a washing bath.

11. In the processing method of the present invention, total processing time (Dry to Dry) is 20 to 120 seconds.

12. In the processing method of the present invention, a roller heating means contacts the photographic material at the front part of a drying unit in the automatic developing machine and is maintained at 70° C. or higher.

13. In the processing method of the present invention, the processing is carried out in a developing tank of an automatic developing machine having the aperture rate of 0.04 or less.

14. In the processing method of the present invention, the developing solution does not substantially contain a boron compound (preferably contains a boron compound in an amount of 10 mmole/liter or less).

15. In the processing method of the present invention, the fixing solution does not substantially contain an aluminum compound (preferably contains an aluminum compound in an amount of 10 mmole/liter or less).

16. In the processing method of the present invention, the processing is carried out in an automatic developing machine which comprises a multi-room bath and is of a multi-stage countercurrent water system.

While the invention has been described in detail and with reference to specific embodiments thereof, it will be apparent to one skilled in the art that various changes and modifications can be made therein without departing from the spirit and scope thereof.

What is claimed is:

1. A processing method comprising development-processing with an automatic developing machine while replenishing a developing solution, a photographic material comprising a support having thereon a silver halide emulsion layer or a constituent layer adjacent to the emulsion layer which contains (i) a silver halide composition comprising at least one of silver bromochloride, silver chloroiodide, or silver bromochloroiodide each having a silver chloride content of 90% mol or more, or silver chloride, and (ii) a compound represented by the following Formula (I)

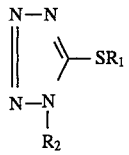

(I)

wherein $R_1$ represents a hydrogen atom, an ammonium group, or an alkali metal atom; and $R_2$ represents a hydrogen atom, an alkyl group, or an aryl group, with a developing solution containing (1) a dihydroxybenzene compound, and (2) an ascorbic acid or a derivative thereof in an amount of at least 5 mole % based on the amount of the dihydroxybenzene compound, wherein said developing solution is replenished in an amount of from 150 to 200 ml per $m^2$ of the photographic material being processed.

2. The processing method as in claim 1, wherein the developing solution has been stored in a vessel of a plastic packaging material having an oxygen permeation of 50 $ml/m^2$, atm.day or less at temperature of 20° C. and relative humidity of 65%.

3. The processing method as in claim 1, wherein the support is transparent and the emulsion layer contains silver halide grains having a (100) face/(111) face ratio of 5 or more and having been spectrally sensitized to 600 nm or more and the material further comprises a colored back layer.

4. The processing method as in claim 1, wherein the support is transparent and the emulsion layer contains silver halide grains having a (111) face/(100) face ratio of 5 or more and having been spectrally sensitized to 600 nm or more and the material further comprises a colored back layer.

5. The processing method as in claim 1, wherein the photographic material has a coated silver amount of 2.6 $g/m^2$ or less and a total gelatin amount of 3.5 $g/m^2$ or less.

6. The processing method as in claim 1, wherein a developing concentrate and a fixing concentrate consisting of one part and each of the concentrates is diluted to a processing solution with water in each tank and supplied as a replenishing solution.

7. The processing method as in claim 1, wherein a vessel for the developing concentrate and the fixing concentrate is an integrated packaging material.

8. The processing method as in claim 1, wherein the amounts of the developing concentrate and the fixing concentrate contained in the vessel are consumed at the same time.

9. The processing method as in claim 1, wherein there is used an automatic developing machine in which a rinsing bath and a rinsing roller (a crossover roller) are disposed between a developing bath and a fixing bath and between the fixing bath and a washing bath.

10. The processing method as in claim 1, wherein the processing occurs in an automatic developing machine in which various anti-deposit agents are contained in a stock bath from which water is supplied to the washing bath and the rinsing bath.

11. The processing method as in claim 1, wherein the processing occurs in an automatic developing machine in which an electromagnetic valve is disposed at an exhaust port of a washing bath.

12. The processing method as in claim 1, wherein total processing time (Dry to Dry) is 20 to 120 seconds.

13. The processing method as in claim 1, wherein a roller heating means contacts the photographic material at the front part of a drying unit in the automatic developing machine and is maintained at 70° C. or higher.

14. The processing method as in claim 1, wherein the processing is carried out in a developing tank of an automatic developing machine having the aperture rate of 0.04 or less.

15. The processing method as in claim 1, wherein the developing solution does not substantially contain a boron compound.

16. The processing method as in claim 1, wherein the fixing solution does not substantially contain an aluminum compound.

17. The processing method as in claim 1, wherein the processing is carried out in an automatic developing machine which comprises a multi-room bath and is of a multi-stage countercurrent water system.

* * * * *